US007228918B2

(12) United States Patent
Evans et al.

(10) Patent No.: US 7,228,918 B2
(45) Date of Patent: Jun. 12, 2007

(54) SYSTEM AND METHOD FOR FORMING AN UNDERGROUND BORE

(75) Inventors: Nigel Evans, The Woodlands, TX (US); Marc Bruderer, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 212 days.

(21) Appl. No.: 10/838,512

(22) Filed: May 4, 2004

(65) Prior Publication Data

US 2005/0061549 A1 Mar. 24, 2005

Related U.S. Application Data

(60) Provisional application No. 60/468,221, filed on May 5, 2003.

(51) Int. Cl.
*E21B 7/04* (2006.01)

(52) U.S. Cl. ..... 175/61; 175/73

(58) Field of Classification Search ..... 175/61, 175/62, 73, 325.5

See application file for complete search history.

(56) References Cited

U.S. PATENT DOCUMENTS

| | | | | |
|---|---|---|---|---|
| 4,176,985 | A | 12/1979 | Cherrington | |
| 4,627,502 | A | 12/1986 | Dismukes | |
| 5,148,875 | A | 9/1992 | Karlsson et al. | |
| 5,165,491 | A | 11/1992 | Wilson | |
| 5,176,211 | A | 1/1993 | Halderman et al. | |
| 5,351,764 | A | 10/1994 | Cherrington | |
| 5,439,064 | A | 8/1995 | Patton | |
| 5,602,541 | A | 2/1997 | Comeau et al. | |
| 6,179,066 | B1 | 1/2001 | Nasr et al. | |
| 6,443,244 | B1 * | 9/2002 | Collins | 175/61 |
| 6,581,699 | B1 | 6/2003 | Chen et al. | |
| 6,749,030 | B2 | 6/2004 | Blair et al. | |
| 2002/0179336 | A1 * | 12/2002 | Schaaf et al. | 175/61 |
| 2003/0121702 | A1 | 7/2003 | Downton et al. | |
| 2004/0050590 | A1 | 3/2004 | Pirovolou et al. | |
| 2004/0104046 | A1 | 6/2004 | Kelpe | |
| 2004/0216921 | A1 * | 11/2004 | Krueger | 175/24 |
| 2005/0000733 | A1 * | 1/2005 | Schaaf | 175/61 |

FOREIGN PATENT DOCUMENTS

| | | |
|---|---|---|
| WO | WO 93/18273 | 9/1993 |

* cited by examiner

*Primary Examiner*—William Neuder
(74) *Attorney, Agent, or Firm*—Madan, Mossman & Sriram, P.C.

(57) ABSTRACT

A system for drilling a substantially horizontal borehole, comprises a rotating drill string extending from a surface system to a location in the horizontal borehole, the drill string having a drill bit at a bottom end. A rotary steerable system in the drill string proximate the drill bit is adapted to direct the rotating drill string toward a desired exit point. In another aspect, a method for drilling a substantially horizontal borehole from a surface location to an offshore exit location, comprises drilling a borehole using a rotary steerable system to direct the borehole along a predetermined trajectory toward the exit location. The borehole is reamed from the surface location toward the exit location while recovering a drilling fluid at the surface location.

42 Claims, 3 Drawing Sheets

SYSTEM AND METHOD FOR FORMING AN UNDERGROUND BORE

CROSS REFERENCE TO RELATED APPLICATIONS

This application claims the benefit of U.S. application Ser. No. 60/468,221 filed on May 5, 2003.

STATEMENT REGARDING FEDERALLY SPONSORED RESEARCH OR DEVELOPMENT

Not Applicable

BACKGROUND OF THE INVENTION

1. Field of the Invention

The present invention relates to systems and methods for horizontal directional drilling and more particularly to the use of a self-controlled, rotary steerable system for use in horizontal direction drilling.

2. Description of the Related Art

Horizontal directional drilling is the application of drilling techniques to steer a drill along a prescribed pathway beneath an obstacle such as a river or beach. This pathway is then enlarged and improved such that a pipeline or conduit can be installed beneath the obstacle. The drill path takes a line below the surface to avoid disturbance of the banks or beach and thereby greatly reduces environmental impact. Commonly, the drill path may be 30 or 40 feet beneath the surface.

Since the surface of the banks or beach are not disturbed, detrimental effects on water quality, vegetation, or wildlife are minimized. Additionally, by drilling beneath the surface of the beach, the risk of erosion is reduced or eliminated. Typically, a drilling rig is set up behind the beach or sand dunes. From there, a pilot hole is drilled at an angle to the surface. The hole continues horizontally below the surface of the beach (typically 30–40 feet below the surface) and exits at a remote submerged location after crossing beneath the beach. Once the pilot drill assembly exits the bore at a submerged location, it is commonly lifted to a barge where a reamer is attached to enlarge the hole. The reamer is drawn back through the hole and the hole is enlarged to roughly 1½ times the diameter of the product conduit. The product conduit is then pulled through the hole from the offshore end. Drilling fluid is pumped through the hole during the drilling and reaming operation. Sufficient volumes of fluid must be pumped to maintain sufficient velocities to adequately remove the drilled cuttings from the hole. The fluid volumes are on the order of 400–600 gpm during the drilling of the pilot hole and may be even higher during the reaming process. Commonly, the drilling fluid contains clay additives to provide sufficient gel strength and viscosity to aid in transporting the drilled cuttings from the borehole. The drilling fluid with cuttings typically exits the hole at the subsea end and the drilling cuttings and clay particles are allowed to settle on the seafloor. The large flow volumes result in a substantial amount of particulate matter being deposited. The cuttings and gel material are normally benign materials. However, environmentally sensitive structures, such as coral reefs, may be damaged by the deposition of large amounts of such material. The result is that the horizontal reach of the borehole is being pushed farther and farther offshore. In some areas, lengths greater than 10,000 ft are required.

Horizontal directional drilling is commonly accomplished by use of a special drilling rig employing a non-rotating drill pipe with a fluid powered cutting tool at its downhole end. Direction is achieved by use of a small angular section in the body of the cutting tool, and by controlling the application of thrust on the drill string. Downhole drilling motors may be used to rotate the bit. In addition, wireline steering tools have been used to determine the path of the long reach borehole, as described in U.S. Pat. No. 4,399,877 to Jackson, et al. Horizontal lengths of 4000–6000 ft are not uncommon using such techniques. Use of such a wireline tool prevents the use of a rotary drilling system.

The limits of the prior art techniques are caused by the friction induced drag of the drill pipe as it lays against the wall of the pilot hole. In addition, the relatively flexible drill pipe tends to buckle as the thrust load is increased, exacerbating the problem. The use of larger diameter, and therefore stiffer, drill pipe may alleviate the buckling problem but aggravates the frictional drag by increasing the weight of the drill pipe. U.S. Pat. No. 6,443,244 to Collins describes the use of buoyant sections of drill string to partially reduce the frictional drag. The resultant sections are substantially larger in diameter and while partially reducing the weight, they drastically increase the surface area in contact with the cuttings on the bottom of the hole and the drag of such a non-rotating system is still to great to prevent very long reach drilling.

The methods and apparatus of the present invention overcome the foregoing disadvantages of the prior art by providing a rotary steerable system and methods for drilling a very long reach borehole while reducing the impact on environmentally sensitive areas.

SUMMARY OF THE INVENTION

In one aspect, a system for drilling a substantially horizontal borehole, comprises a rotating drill string extending from a surface system to a location in the horizontal borehole, the drill string having a drill bit at a bottom end. A surface system pushes and rotates the drill string. A rotary steerable system in the drill string proximate the drill bit is adapted to direct the rotating drill string toward a desired exit point.

In another aspect, a method for drilling a substantially horizontal borehole from a surface location to an offshore exit location, comprises drilling a pilot hole using a rotary steerable system to direct the pilot hole toward the exit location. The pilot hole is reamed from the surface location toward the exit location while recovering a drilling fluid at the surface location.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION

Figure 1:
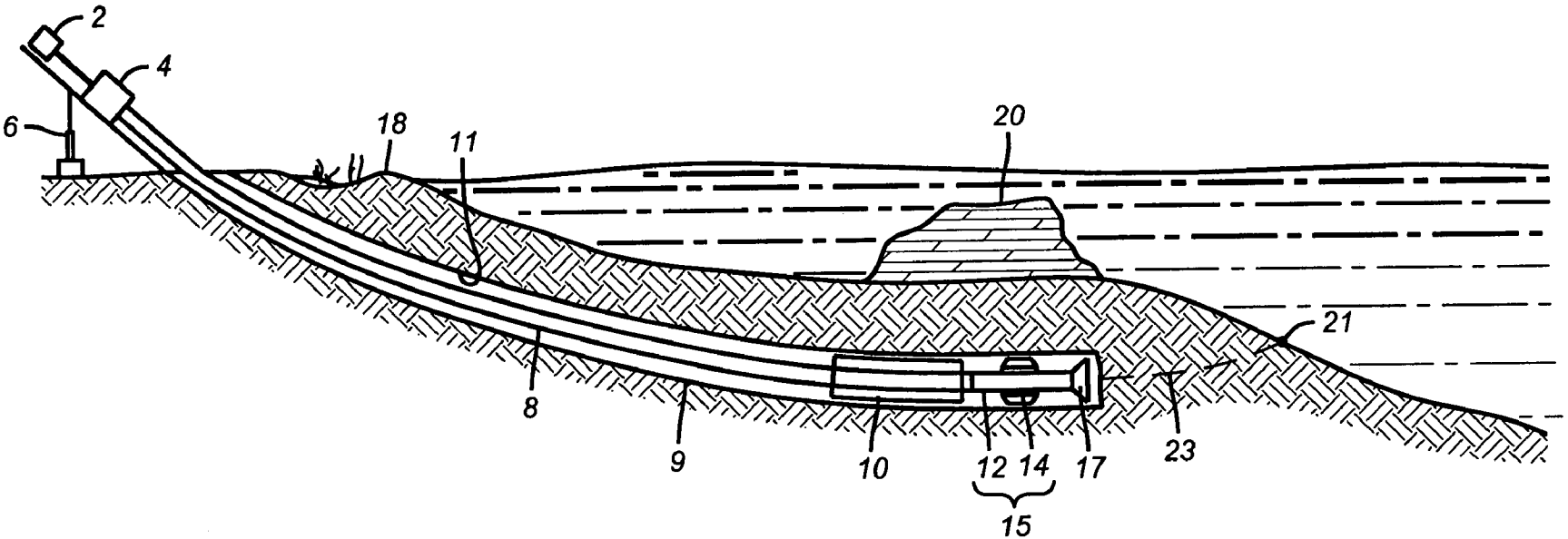
FIG. 1 is a schematic diagram showing a drilling system engaged in drilling operations according to one embodiment of the present invention.

The drilling rig being used for horizontal directional drilling, according to one embodiment, is a ramp style rig shown schematically at 1 in FIG. 1. The rig is mounted onshore and removed back from the environmentally sensitive beach area 18. Located on the seabed, and at a distance offshore, is an environmentally sensitive structure 20 such as a coral reef. The borehole 9 is intended to travel under the beach 18 and the reef 20 and to exit at a suitable predetermined distance at location 21.

Referring to drilling rig 1, the ramp serves the same purpose as a derrick on a standard vertical drilling rig. The ramp may be elevated at one end by means of a pivoting leg system 6 to raise the ramp to a predetermined angle from the horizontal. The rig includes a rotary table 4 and a thruster 2. The rotary table is driven by hydraulic or electric motors. A mud pumping system (not shown) is skid mounted adjacent the ramp and utilizes suitable pumps to operate the mud system. When a joint of pipe is installed, the thruster 2 advances the drill string 8 while the rotary table rotates the pipe, as hole is made in the earth, until the length of pipe is drilled into the earth. Then the upper end of the drill string 8 is disconnected, the thruster is retracted up the ramp and the next joint of pipe is added to the pipe string 8 and drilling is continued. The mud system functions as on a conventional drilling rig. The mud is pumped down the drill pipe to lubricate the hole and act as a medium to carry cuttings out of the hole as the mud recirculates to the surface. A rotary steerable system 15 is attached at the bottom of the drill string 8 and has a drill bit 17 attached thereto.

Figure 2:
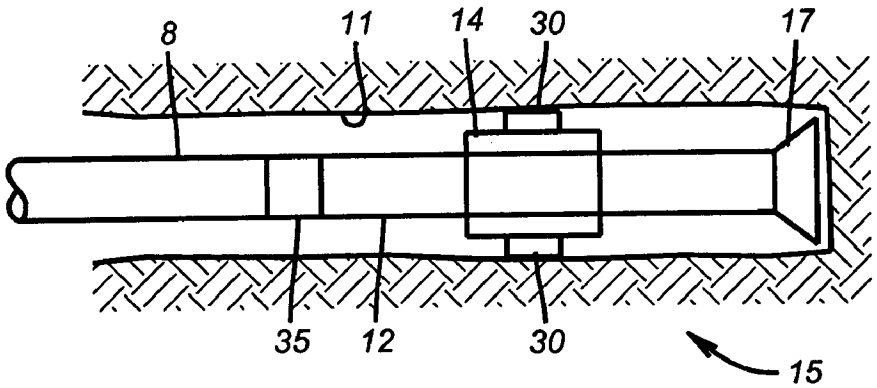
FIG. 2 is a schematic of a rotary steerable system as used in at least one embodiment of the present invention.

In one embodiment, the rotary steerable system 15, see FIG. 2, has a non-rotating stabilizer 14 on a rotating mandrel 12 where the mandrel 12 is attached to the rotating drill string 8. The non-rotating stabilizer 14 has independent radially adjustable members 30 that can be extended to contact the borehole wall 11 and exert a predetermined force on the borehole wall 11 to cause the system to follow the planned borehole trajectory 23. The rotary steerable system 15 has directional sensors (not shown) for determining the inclination and azimuth of the system. The directional sensors may include, but are not limited to, multi-axis inclinometers, multi-axis magnetometers, and gyroscopic devices, including rate and inertial type gyroscopic devices known in the art. The rotary steerable system 15 has a controller (not shown) onboard. The controller has suitable circuits for powering the directional sensors and a processor with memory. In one embodiment, the processor has a downloaded planned borehole trajectory loaded in memory and the processor acts under programmed instructions to determine any deviations from the planned borehole trajectory. The processor determines suitable corrections to return to the planned trajectory and controls the forces exerted by adjustable members 30 to return the actual path to the planned trajectory. Alternatively, in order to reduce dogleg severity, the processor may use suitable trajectory calculation models known in the art to calculate a new trajectory to reach the desired exit point 21 without returning to the originally planned trajectory.

In one embodiment, see FIG. 2, the steerable system 15 includes a telemetry module 35 for sending signals from the steerable system 15 to a surface transmitter/receiver (not shown). The telemetry module 35 may be (i) a mud pulse module for sending encoded mud pulses to the surface through the drilling fluid, (ii) an acoustic telemetry device for sending encoded acoustic signals in the drill string 8 to the surface, (iii) an electromagnetic telemetry module, or (iv) any other suitable telemetry device known in the art. Likewise, the rotary steerable system 15 may have a receiver for receiving encoded signals from the surface. In one embodiment, the downhole measurements may be sent to the surface for review and analysis by the operator. Updated trajectories or other commands may be downloaded to the controller in the rotary steerable system 15 from the surface transmitter/receiver using such telemetry techniques.

In another embodiment, the rotary steerable system 15 may include sensors for detecting formation parameters of interest of the surrounding formation. For example, detecting changes in formation resistivity may indicate distance to the seafloor and proximity to exit location 21. In addition, the drilling fluid pressure may be measured inside and outside the steerable system 15 to calculate such parameters as Equivalent Circulating Density (ECD) used for indicating hole cleaning and preventing formation fracture with attendant lost circulation and possible seafloor contamination.

In operation, the rotary steerable system is loaded with a desired planned trajectory and is capable of operating in a closed loop manner. The sensors in the steerable system are use by an onboard controller to determine the actual drill path and determine any deviations from the planned trajectory. The controller controls the adjustable members to correct the path of the steerable system. In order to prevent the contamination of the seafloor and any environmentally sensitive structures such as coral reef 20, the following method is used for normal length horizontal holes. The method provides for drilling, enlarging and completing the installation of a desired product conduit. The pilot hole is drilled, as described above, using rotary steerable system 15 to a position a predetermined distance short of the exit location 21. A cement plug is installed in the borehole proximate the exit location 21 to prevent the drilling fluid pressure from washing the hole out to the seafloor. The drill string is removed from borehole 9. The hole is then enlarged with a reamer (not shown) driven from the land side of borehole 9. The drilling fluid is returned back to the land mud system and the large volume of drilling fluid normally associated with reaming does not spread on the seafloor. The product conduit is suitably laid out on the seafloor near the exit location 21 using techniques known in the art. The cement plug is drilled out and the circulation stopped to prevent any substantial leakage to the seafloor. The product conduit is attached to the end of the reamer and pulled back through the enlarged hole to the proper position. The conduit is then secured in the borehole using techniques known in the art. The method as described provides for minimal seafloor contamination.

In another embodiment, still referring to FIGS. 1 and 2, a very long reach borehole may be achieved using a rotating drill string 8 having a predetermined length of buoyant drill string 10. The predetermined length of buoyant drill string 10 is used to reduce the weight of the drill string 8 laying against the wall of borehole 9 thus reducing the frictional drag forces exerted on the drill string and allowing the thruster 2 and the rotary 4 to drive the steerable system 15 to the very long reach distances. The buoyant drill string 10 may use individual sections of buoyant drill pipe connected together.

Figure 3:
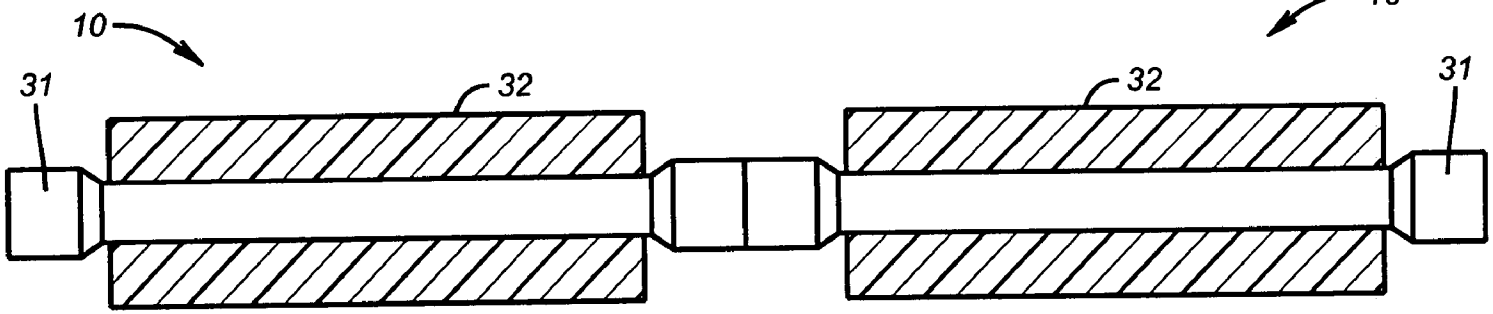
FIG. 3 is a schematic of a buoyant section of drill pipe according to one embodiment of the present invention.

Buoyant drill string sections 10 may be used for very long extended reach boreholes (greater than approximately 6000 ft in horizontal length), as required. For the purposes of this invention, any type of buoyant drill string may be used. For example, FIG. 3 shows individual sections of drill pipe 31 with attached buoyancy modules 32. The buoyancy modules 32 may be (i) a buoyant foam material, (ii) an inflatable bladder, and (iii) a sealed chamber having a pressurized fluid of a predetermined density. The pressurized fluid may be a liquid or a gas. The buoyancy modules 32 may be integral with the drill pipe 31 to increase the relative stiffness of the sections 10. The buoyancy modules 32 may substantially increase the effective diameter of the drill string thereby increasing the flow velocities in the local annulus between the borehole and the drill string and improving the hole cleaning in that area.

Figure 4:
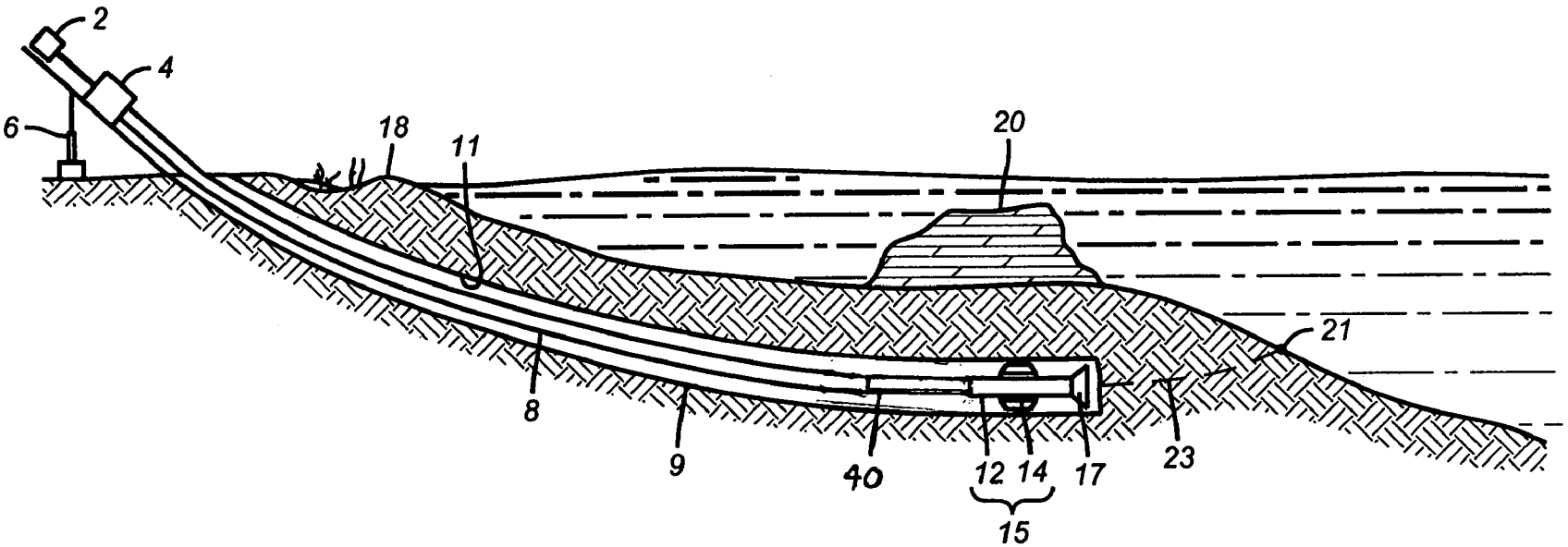
FIG. 4 is a schematic of a rotating drill string having a drilling motor located above and providing addition rotary motion to a rotary steerable system.

In another embodiment, see FIG. 4, a drilling motor 40 is inserted in drill string 8 above the rotary steerable system 15 such that rotary steerable system 15 is attached to the output shaft of drilling motor 40. Drilling motor 40 is a positive displacement motor actuated by the flow of drilling fluid through the motor 40. Alternatively, a fluid driven turbine motor (not shown) may be used. Such motors are know in the art and are not described here further. Drilling motor 40 may be used by itself or in conjunction with rotary table 4 to drive drill bit 17. In one mode, rotary table 4 may be used to rotate drill string 8 at a relatively low speed, for example, 20–30 rpm, while drilling motor 40, combined with rotary table 4 drives the bit at a significantly higher speed, for example 150–200 rpm. Alternatively, both rotary table 4 and drilling motor 40 may each be driven at their rated speeds dramatically increasing the rotary speed of drill bit 17 and increasing the penetration rate of the system. Any suitable combination of rotary table 4 speed and drilling motor 40 speed may be used. One skilled in the art will appreciate that a desirable speed is location dependent and may be decided at the drilling site. The ability to combine rotary table drive and drilling motor drive combined with the rotary steerable system 15 provides enhanced flexibility to the operator. The system as described in FIG. 4 may be used in conjunction with the buoyant drill pipe described previously.

While the present invention has been described above in the context of a beach crossing, it is intended that it be equally suitable for river crossing and any other relatively long, shallow borehole. Examples include, but are not limited to, underground placement of utility shafts, sewer lines, and pipelines.

The foregoing description is directed to particular embodiments of the present invention for the purpose of illustration and explanation. It will be apparent, however, to one skilled in the art that many modifications and changes to the embodiment set forth above are possible. It is intended that the following claims be interpreted to embrace all such modifications and changes.

What is claimed is:

1. A system for drilling a borehole, comprising:

a rotating drill string extending from a surface system to a location in said borehole, said drill string including a buoyant member;

a surface system conveying said drill string into said borehole; and a rotary steerable system associated with said drill string that directs said rotating drill string along a predetermined borehole trajectory; wherein the rotary steerable system comprises a telemetry module for communicating with a surface transmitter/receiver.

2. The system of claim 1, wherein the rotary steerable system comprises a non-rotating stabilizer.

3. The system of claim 2, wherein the non-rotating stabilizer comprises a radially adjustable member wherein said radially adjustable member is extendable to contact a wall of the borehole.

4. The system of claim 1, wherein said rotary steerable system comprises a controller having a processor and a memory, said controller directing said rotary system, according to programmed instructions, along the predetermined borehole trajectory.

5. The system of claim 4, wherein the predetermined borehole trajectory is stored in the controller memory.

6. The system of claim 1, wherein the rotary steerable system comprises a directional sensor for determining parameters of interest related to the borehole trajectory.

7. The system of claim 1, wherein the surface transmitter/receiver is adapted to transmit an updated borehole trajectory to the rotary steerable system.

8. The system of claim 1, wherein the telemetry module is adapted to transmit at least one of (i) mud pulse signals in the drilling fluid, (ii) acoustic signals in the drill string, and (iii) electromagnetic signals.

9. The system of claim 1, wherein the buoyant member comprises a buoyancy module attached to the drill string.

10. The system of claim 9, wherein the buoyancy module is comprised of at least one of (i) a buoyant foam material, (ii) an inflatable bladder, and (iii) a sealed chamber having a pressurized fluid of a predetermined density therein.

11. The system of claim 9, wherein the buoyancy module is integral with the drill string to increase the stiffness of the drill string.

12. The system of claim 1, further comprising a drilling motor in said drill string above said rotary steerable system and adapted to provide rotational motion to said rotary steerable system in addition to the rotating motion of the rotating drill string.

13. The system of claim 12, wherein the drilling motor is one of (i) a fluid driven positive displacement motor, and (ii) a fluid driven turbine motor.

14. The system of claim 1, wherein the borehole is placed under at least one of (i) a beach, (ii) a subsea structure, and (iii) a river.

15. A system for drilling a borehole, comprising:

a rotating drill string extending from a surface system to a location in said borehole, said drill string including a buoyant member;

a surface system conveying said drill string into said borehole; and a rotary steerable system associated with said drill string that directs said rotating drill string along a predetermined borehole trajectory, wherein the rotary steerable system comprises a sensor for detecting a parameter of interest.

16. The system of claim 15, wherein the parameter of interest is formation resistivity.

17. The system of claim 15, wherein the parameter of interest is drilling fluid pressure.

18. A method for drilling a substantially horizontal borehole, comprising:

extending a rotating drill string having a rotary steerable system attached thereto from a surface location into said borehole, said rotary steerable system adapted to direct said borehole along a predetermined trajectory toward a predetermined exit location;

stopping said borehole at a predetermined distance from said exit location; and reaming said borehole from said surface location toward said exit location while recovering a drilling fluid at said surface location.

19. The method of claim 18, further comprising:

drilling out said borehole to said predetermined exit location;

attaching a conduit to said drill string; and pulling said conduit through said borehole to said surface location.

20. The method of claim 18, wherein the rotary steerable system comprises a non-rotating stabilizer.

21. The method of claim 20, wherein the non-rotating stabilizer comprises a radially adjustable member wherein said radially adjustable member is extendable to contact a wall of the borehole.

22. The method of claim 18, wherein said rotary steerable system comprises a controller having a processor and a memory, said controller directing said rotary system, according to programmed instructions, along the predetermined borehole trajectory.

23. The method of claim 22, wherein the predetermined borehole trajectory is stored in the controller memory.

24. The method of claim 18, wherein the rotary steerable system comprises a directional sensor for determining parameters of interest related to the borehole trajectory.

25. The method of claim 18, wherein the rotary steerable system comprises a telemetry module for communicating with a surface transmitter/receiver.

26. The method of claim 25, wherein the surface transmitter/receiver is adapted to transmit an updated borehole trajectory to the rotary steerable system.

27. The method of claim 25, wherein the telemetry module is adapted to transmit at least one of (i) mud pulse signals in the drilling fluid, (ii) acoustic signals in the drill string, and (iii) electromagnetic signals.

28. The method of claim 18, wherein the rotary steerable system comprises a sensor for detecting a parameter of interest.

29. The method of claim 28, wherein the parameter of interest is formation resistivity.

30. The method of claim 28, wherein the parameter of interest is drilling fluid pressure.

31. The method of claim 18, further comprising a buoyancy module attached to the drill string.

32. The method of claim 31, wherein the buoyancy module is comprised of at least one of (i) a buoyant foam material, (ii) an inflatable bladder, and (iii) a sealed chamber having a pressurized fluid of a predetermined density therein.

33. The method of claim 31, wherein the buoyancy module is integral with the drill string to increase the stiffness of the drill string.

34. The method of claim 18, further comprising inserting a drilling motor in said drill string above said rotary steerable system, said drilling motor adapted to provide rotational motion to said rotary steerable system in addition to the rotating motion of the rotating drill string.

35. The method of claim 34, wherein the drilling motor is one of (i) a fluid driven positive displacement motor, and (ii) a fluid driven turbine motor.

36. The method of claim 18, wherein the borehole is placed under at least one of (i) a beach, (ii) a subsea structure, and (iii) a river.

37. A method for drilling a borehole, comprising:

rotating a drill string that includes a buoyant member to drill the borehole;

steering the drill string with a rotary steerable system to direct said rotating drill string along a predetermined borehole trajectory;

directing the drill string toward a predetermined exit location; and stopping said borehole at a predetermined distance from said exit location.

38. The method of claim 37, further comprising:

installing a cement plug in the borehole.

39. The method of claim 37, further comprising:

retrieving the drill string from the borehole; and reaming the borehole while recovering a drilling fluid at said surface location.

40. The method of claim 39, further comprising:

positioning a product conduit in the borehole.

41. The method of claim 37, wherein the buoyant member is a buoyancy module attached to the drill string.

42. The method of claim 41, wherein the buoyancy module is comprised of at least one of (i) a buoyant foam material, (ii) an inflatable bladder, and (iii) a sealed chamber having a pressurized fluid of a predetermined density therein.

* * * * *